US005974289A

United States Patent [19]

Yamaguchi

[11] Patent Number: 5,974,289

[45] Date of Patent: Oct. 26, 1999

[54] COLOR IMAGE FORMING APPARATUS

[75] Inventor: Chiseki Yamaguchi, Niigata, Japan

[73] Assignee: NEC Corporation, Tokyo, Japan

[21] Appl. No.: 09/181,638

[22] Filed: Oct. 29, 1998

[30] Foreign Application Priority Data

Oct. 30, 1997 [JP] Japan ..... 9-298926

[51] Int. Cl.[6] ..... G03G 15/00

[52] U.S. Cl. ..... 399/124; 399/125

[58] Field of Search ..... 399/124, 125, 399/110, 111, 107, 112; 347/138, 152

[56] References Cited

U.S. PATENT DOCUMENTS

| | | | |
|---|---|---|---|
| 4,668,072 | 5/1987 | Yasuda | 399/111 |
| 5,065,195 | 11/1991 | Haneda et al. | 399/112 |
| 5,253,015 | 10/1993 | Morita et al. | 399/111 X |
| 5,262,824 | 11/1993 | Morita et al. | 399/112 X |
| 5,268,720 | 12/1993 | Saitoh et al. | 399/110 |
| 5,345,295 | 9/1994 | Takano et al. | 399/125 |
| 5,438,391 | 8/1995 | Maekawa et al. | 399/125 |
| 5,608,498 | 3/1997 | Nagase et al. | 399/130 |

FOREIGN PATENT DOCUMENTS

| | | |
|---|---|---|
| 2-262676 | 10/1990 | Japan . |
| 3-111861 | 5/1991 | Japan . |
| 4-131859 | 5/1992 | Japan . |
| 5-323690 | 12/1993 | Japan . |
| 7-325444 | 12/1995 | Japan . |
| 8-211816 | 8/1996 | Japan . |

*Primary Examiner*—Sandra Brase
*Assistant Examiner*—Sophia S. Chen
*Attorney, Agent, or Firm*—Foley & Lardner

[57] ABSTRACT

A color image forming apparatus of the present invention includes an image transfer part openable frontward about the lower portion of the apparatus, and a belt part openable upward about the rear portion of the apparatus. With this configuration, the apparatus promotes easy handling of a paper jam and efficient maintenance.

15 Claims, 2 Drawing Sheets

COLOR IMAGE FORMING APPARATUS

BACKGROUND OF THE INVENTION

The present invention relates to a color image forming apparatus and, more particularly, to a color image forming apparatus promoting efficient maintenance and easy handling of a paper jam.

An electrophotographic color image forming apparatus, as distinguished from a monochromatic image forming apparatus, needs a plurality of developing units each assigned to a particular color, e.g., one of yellow, magenta, cyan, and black. Further, a color image forming apparatus involves a sophisticated process including development and image transfer with different colors being superposed one above the other and the fixation of laminate toner. In addition, developers of different colors must be replenished from time to time. On the other hand, a photoconductive element or image carrier and an intermediate transfer body included in the apparatus are frequently replaced, so that measures against paper jams are necessary. In these circumstances, there is an increasing demand for an image forming apparatus promoting efficient maintenance and easy handling of a paper jam.

Japanese Patent Laid-Open Publication No. 5-323690, for example, discloses a color image forming apparatus having a clamshell type structure made up of an upper body part and a lower body part. The upper body part is movable, or openable, about a shaft away from the lower body part. A photoconductive belt and a case accommodating developing units are constructed into a cartridge. The cartridge is mounted to the apparatus while being positioned relative to a laser writing unit. When a paper or similar recording medium jams a transport path, the operator opens the upper body part away from the lower body part in order to uncover the path and then removes the paper.

However, a problem with the above clamshell type apparatus is that the upper body part is bulky and heavy and thereby difficult to operate. Further, a sufficient space for removing a jamming paper is not available with the apparatus. Moreover, removing a jamming paper under such a heavy article is not desirable from the safety standpoint. In addition, the cartridge including the belt and developing units is bulky and difficult to replace.

Japanese Patent Laid-Open Publication No. 2-262676 teaches a color image forming apparatus including a photoconductive belt and developing units constructed into a cartridge removable from the apparatus. A transport path for transferring an image to a paper or similar recording medium is formed above the belt. A cover covering the transport path is openable upward away from the belt. After the cover including an image transfer section has been opened upward, the above cartridge is removed sideways for replacement. This, however, cannot be done without resorting to sufficient spaces above and at the side of the apparatus that originally has a substantial size. As a result, a broad space is necessary for the installation of the apparatus. In addition, the cartridge is bulky and awkward to replace.

Japanese Patent Laid-Open Publication No. 8-211816 proposes a color image forming apparatus including a top cover. When the top cover is opened, a cartridge including a photoconductive element and developing units can be moved upward in order to uncover a transport path. With this kind of apparatus, the operator intending to remove a jamming paper must open the top cover and then lift the cartridge including the photoconductive element and developing units. This obstructs efficient maintenance.

Japanese Patent Laid-Open Publication No. 7-325444 discloses a color image forming apparatus including a top body part openable upward about a shaft mounted on the rear portion of the apparatus. A unit including a photoconductive element and an intermediate transfer body is removably mounted to the upper body part. A cover is mounted on the top body part and may be opened in order to remove a jamming paper. This apparatus has a drawback that although the photoconductive element and development units are constructed integrally, a paper jamming an image transfer station must be dealt with at the top rear side of the apparatus, resulting in troublesome work. Moreover, the apparatus gives no consideration to a paper jam apt to occur just after a paper cassette. In addition, because printings are driven out to the rear of the apparatus although face up, the apparatus needs a broad space and renders the handling of printings awkward.

SUMMARY OF THE INVENTION

It is therefore an object of the present invention to provide a color image forming apparatus promoting easy handling of a paper and efficient operation.

In accordance with the present invention, a color image forming apparatus including a belt part having a photoconductive belt therein and an image transfer part includes a mechanism for allowing the image transfer part to be opened frontward about the lower portion of the apparatus, and a mechanism for allowing the belt part to be opened upward about the rear portion of the apparatus.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
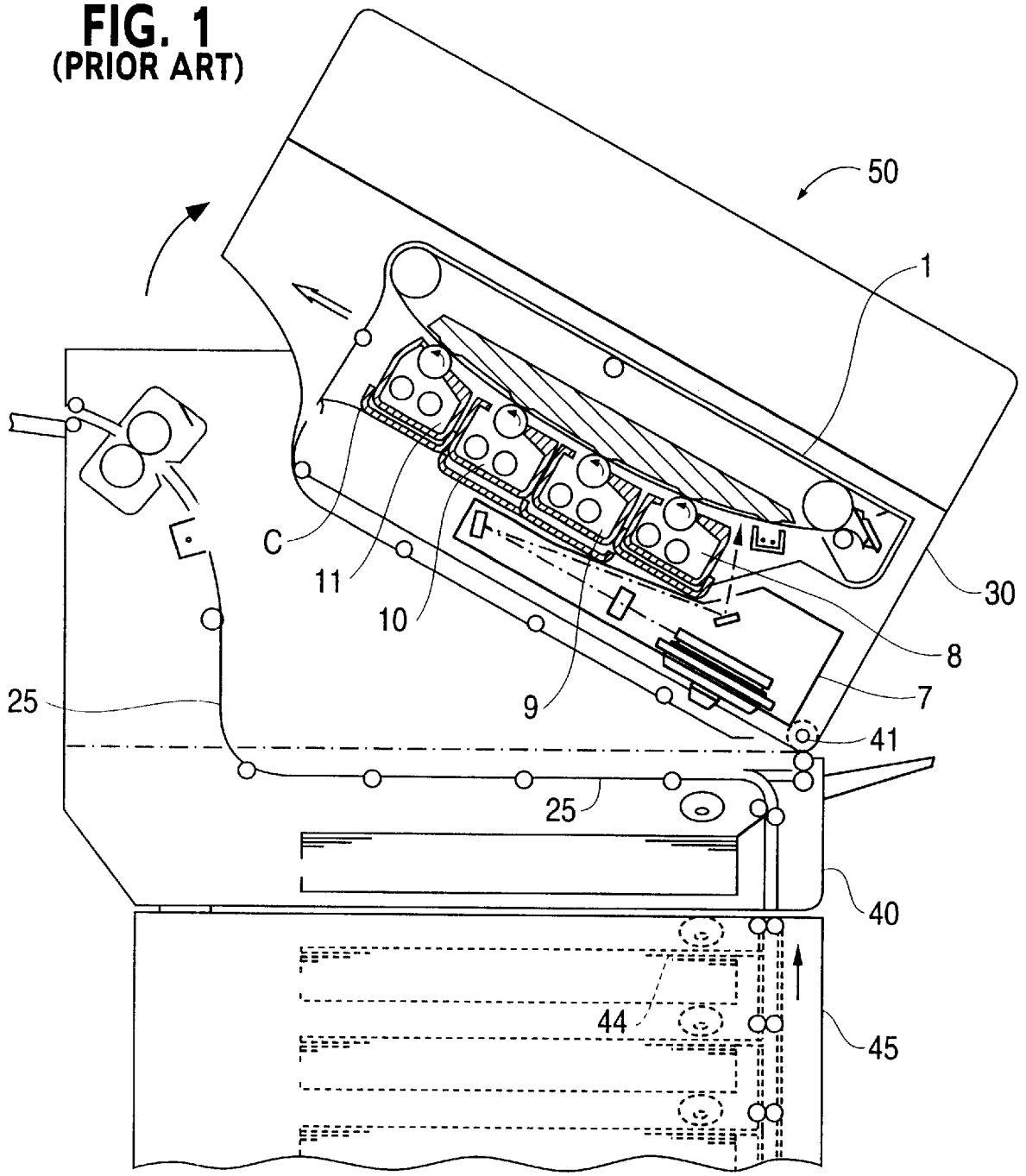
FIG. 1 (PRIOR ART)
FIG. 1 is a section showing a conventional color image forming apparatus.

To better understand the present invention, brief reference will be made to a conventional color image forming apparatus with an improved countermeasure against a paper jam, shown in FIG. 1. The apparatus to be described is taught in Japanese Patent Laid-Open Publication No. 5-323690 mentioned earlier. As shown, the apparatus, generally 50, includes an upper body part 30 and a lower body part 40 connected to each other by a common shaft 41. The upper body part 30 is rotatable about the shaft 41 toward and away from the lower body part 40. A photoconductive belt 1 and a case C accommodating developing units 8, 9, 10 and 11 are constructed into a cartridge. The cartridge is mounted to the apparatus 50 while being positioned relative to a laser writing unit 7. A paper or similar recording medium 44 is fed from a paper feed unit 45 along a preselected transport path 25. When the paper jams the paper transport path 25, the operator opens the upper body part 30 away from the lower body part 40 in order to uncover the path 25 and then removes the paper. For details of such a configuration, reference may be made to the above document.

The conventional apparatus shown in FIG. 1 has some problems left unsolved, as discussed earlier.

Figure 2A:
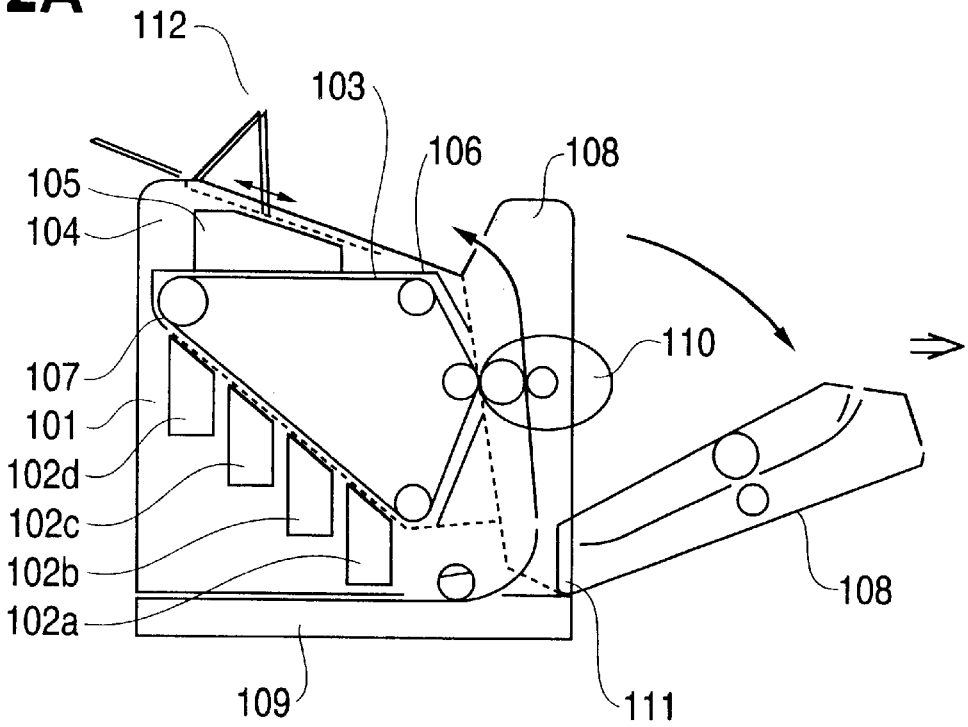
FIGS. 2A and 2B are sections showing a color image forming apparatus embodying the present invention.
Figure 2B:
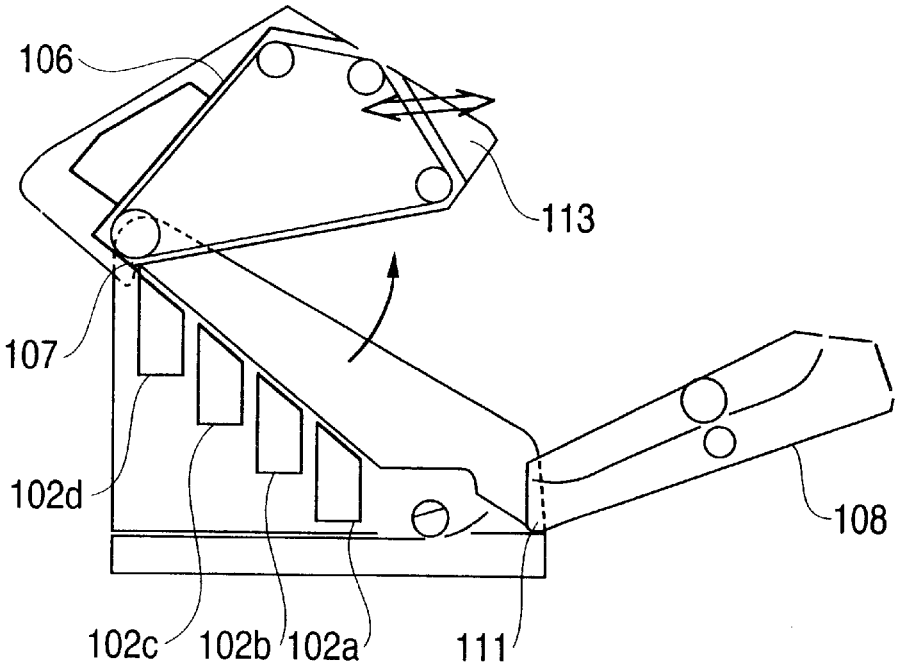

Referring to FIGS. 2A and 2B, a color image forming apparatus embodying the present invention is shown. As shown, the apparatus is generally made up of a body part 101, an image transfer part 108, and a belt part 104. The body part 101 includes developing sections 102*a*, 102*b*, 102*c* and 102*d* each assigned to a particular color for implementing multicolor image formation. The developing sections 102*a*–102*d* are arranged stepwise below a photoconductive belt 103 such that they face a part of the belt 103 movable in a downwardly inclined position with its photoconductive surface facing downward, as illustrated. A shaft 111 is mounted on the front bottom portion of the body part 101. The image transfer part 108 is rotatable, or openable, about the shaft 111 away from the front of the body part 101. The image transfer part 108 transfers a color image from the belt 103 to a paper or similar recording medium. The belt part 104 is movable, or openable, about a shaft 107 mounted on the rear portion of the body part 101 upward away from the body part 101. A belt unit 106 including the belt 103 is removably mounted to the belt part 104.

The belt 103 is mounted on the belt part 104 such that it is rotatable in the configuration shown in FIG. 1. A postprocessing section 105 faces the outer surface of the upper portion of the belt 103 in order to remove a needless solvent from a color image formed on the belt 103.

A paper cassette 109 is positioned on the bottom of the body part 101. The image transfer part 108 is constructed such that a paper fed from the cassette 109 is conveyed to a preselected position above the belt 104 via an image transfer section 110, as indicated by an arrow in FIG. 2A. The image transfer section 110 includes an intermediate roller and a transfer roller and is constantly pressed against the belt 103 by a spring or similar biasing means. The paper fed from the cassette 109 is passed through a nip between the intermediate roller and the transfer roller. The image transfer section 110 may be released from the belt 103 by canceling the bias of the spring or similar biasing means acting on the unit 110.

A cover 112 covers the top of the belt part 104 and is openably supported by the rear side of the belt part 104. The cover 112 is openable at the time of maintenance of the postprocessing section 105, as indicated by a double-headed arrow in FIG. 2A.

Assume that a paper fed from the cassette 109 jams a transport path in the image transfer part 108. Then, the operator cancels the bias of the spring or similar biasing means urging the image transfer section 110 against the belt 103. Subsequently, as shown in FIG. 2A, the operator opens the image transfer part 108 about the shaft 111 away from the body part 101 and then removes the jamming paper.

To replace the belt 103 at the time of maintenance, the operator opens the image transfer part 108 away from the body part 101. Then, as shown in FIG. 2B, the operator opens the belt part 104 upward away from the body part 101 by holding a lever 113. In this condition, the operator removes the belt unit 106 including the used belt 103 from the belt part 104, mounts a new belt 103 to the belt unit 106, closes the belt part 104 by holding the lever 113, and then closes the image transfer part 108. The lever 113 does not rise above the apparatus when the operator opens or closes the belt part 104.

The developing sections 102*a*–102*d* may be maintained after the belt unit 106 has been removed from the belt part 104. To maintain the postprocessing section 105, the operator opens the cover 112 covering the top of the belt part 104. After the maintenance, the operator closes the cover 112.

In summary, a color image forming apparatus of the present invention includes an image transfer part openable frontward about the lower portion of the apparatus, and a belt part openable upward about the rear portion of the apparatus. With this configuration, the apparatus of the present invention achieves various unprecedented advantages, as enumerated below.

(1) A paper or similar recording medium jamming any part of a transfer path extending from a paper feed section to a paper discharge section can be dealt with at the front of the apparatus without exception.

(2) A photoconductive belt can be easily removed at the front of the apparatus only if a belt part is opened.

(3) A biasing force urging an image transfer section against the belt is varied when the image transfer part is opened or closed. The image transfer part can therefore be safely opened or closed by a minimum of force.

(4) Because the image transfer part is opened before the replacement of the belt, a broad space is available for the replacement of the belt, facilitating manipulation.

(5) All manipulation can be performed at the front of the apparatus. This reduces a space for the installation of the apparatus.

(6) A postprocessing section can be easily maintained only if a cover covering the top of the belt part is opened.

(7) Because developing units are not included in the belt part, the belt part is lightweight and can be easily opened upward.

(8) The developing units are arranged stepwise from the front to the rear of the apparatus and can therefore be maintained with ease.

(9) The developing units are arranged in a body part, so that the apparatus can be implemented with either one of a dry development scheme and a wet development scheme.

(10) The operator's hand does not have to be raised above the apparatus when opening the belt part upward or when opening or closing the cover. This successfully reduces the operator's burden.

Various modifications will become possible for those skilled in the art after receiving the teachings of the present disclosure without departing from the scope thereof.

What is claimed is:

1. A color image forming apparatus including a belt part having a photoconductive belt therein and an image transfer part, said image forming apparatus comprising:

a mechanism for allowing said image transfer part to be opened frontward about a lower portion of said apparatus; and a mechanism for allowing said belt part to be opened upward about a rear portion of said apparatus, wherein before said image transfer part is opened frontward about a lower portion of said apparatus or closed toward said apparatus, a biasing force urging a transfer roller included in said image transfer part against said photoconductive belt is varied.

2. A color image forming apparatus comprising:

a belt part removably supporting a belt unit including a photoconductive belt;

a body part including a plurality of developing sections sequentially arranged stepwise below said photoconductive belt such that said plurality of developing sections face a part of said photoconductive belt movable in an inclined position with a photoconductive surface facing downward; and an image transfer part openable frontward away from said body part about a shaft mounted on a front lower portion of said body part, said image transfer part being capable of transferring a color image from said photoconductive belt to a recording medium, wherein said belt part is openable upward away from said body part about a shaft mounted on a rear portion of said body part, and before said image transfer part is opened away from said body part or closed toward said body part, a biasing force urging a transfer roller included in said image transfer part against said photoconductive belt is varied.

3. An apparatus as claimed in claim 2, wherein said belt unit is removable from said belt part when said belt part is opened away from said body part.

4. An apparatus as claimed in claim 2, wherein when said image transfer part is open, said belt part is openable away from said body part.

5. An apparatus as claimed in claim 2, wherein said belt part includes a postprocessing section positioned above said photoconductive belt and a cover openable about a shaft mounted on a rear portion of said belt part.

6. A color image forming apparatus comprising:

a belt part removably supporting a belt unit including a photoconductive belt;

a body part including a plurality of developing sections sequentially arranged stepwise below said photoconductive belt such that said plurality of developing sections face an outer surface of a part of said photoconductive belt movable in an inclined position with respect to a horizontal; and an image transfer part for transferring a color image from said photoconductive belt to a recording medium, wherein said belt part is openable upward away from said body part about a shaft mounted on a rear portion of said body part, and before said image transfer part is opened away from said body part or closed toward said body part, a biasing force urging a transfer roller included in said image transfer part against said photoconductive belt is varied.

7. An apparatus as claimed in claim 6, wherein said belt unit is removable from said belt part when said belt part is opened away from said body part.

8. An apparatus as claimed in claim 6, wherein when said image transfer part is open, said belt part is openable away from said body part.

9. An apparatus as claimed in claim 6, wherein said belt part includes a postprocessing section positioned above said photoconductive belt and a cover openable about a shaft mounted on a rear portion of said belt part.

10. A color image forming apparatus including a belt part having a photoconductive belt therein and an image transfer part, said image forming apparatus comprising:

a mechanism for allowing said image transfer part to be opened frontward about a lower portion of said apparatus; and a mechanism for allowing said belt part to be opened upward about a rear portion of said apparatus, wherein said belt part includes a postprocessing section positioned above said photoconductive belt and a cover openable about a shaft mounted on a rear portion of said belt part.

11. A color image forming apparatus comprising:

a belt part removably supporting a belt unit including a photoconductive belt;

a body part including a plurality of developing sections sequentially arranged stepwise below said photoconductive belt such that said plurality of developing sections face a part of said photoconductive belt movable in an inclined position with a photoconductive surface facing downward; and an image transfer part openable frontward away from said body part about a shaft mounted on a front lower portion of said body part, said image transfer part being capable of transferring a color image from said photoconductive belt to a recording medium, wherein said belt part is openable upward away from said body part about a shaft mounted on a rear portion of said body part, and wherein said belt part includes a postprocessing section positioned above said photoconductive belt and a cover openable about a shaft mounted on a rear portion of said belt part.

12. A color image forming apparatus comprising:

a belt part removably supporting a belt unit including a photoconductive belt;

a body part including a plurality of developing sections sequentially arranged stepwise below said photoconductive belt such that said plurality of developing sections face an outer surface of a part of said photoconductive belt movable in an inclined position with respect to a horizontal; and an image transfer part for transferring a color image from said photoconductive belt to a recording medium, wherein said belt part is openable upward away from said body part about a shaft mounted on a rear portion of said body part, and wherein said belt part includes a postprocessing section positioned above said photoconductive belt and a cover openable about a shaft mounted on a rear portion of said belt part.

13. A color image forming apparatus including a belt part having a photoconductive belt therein and an image transfer part, said image forming apparatus comprising:

a mechanism for allowing said image transfer part to be opened frontward about a lower portion of said apparatus; and a mechanism for allowing said belt part to be opened upward about a rear portion of said apparatus, wherein said belt part can only be opened after said image transfer part has been opened.

14. A color image forming apparatus comprising:

a belt part removably supporting a belt unit including a photoconductive belt;

a body part including a plurality of developing sections sequentially arranged stepwise below said photoconductive belt such that said plurality of developing sections face a part of said photoconductive belt movable in an inclined position with a photoconductive surface facing downward; and an image transfer part openable frontward away from said body part about a shaft mounted on a front lower portion of said body part, said image transfer part being capable of transferring a color image from said photoconductive belt to a recording medium, wherein said belt part is openable upward away from said body part about a shaft mounted on a rear portion of said body part, and said belt part can only be opened after said image transfer part has been opened.

15. A color image forming apparatus comprising:

a belt part removably supporting a belt unit including a photoconductive belt;

a body part including a plurality of developing sections sequentially arranged stepwise below said photoconductive belt such that said plurality of developing sections face an outer surface of a part of said photoconductive belt movable in an inclined position with respect to a horizontal; and an image transfer part for transferring a color image from said photoconductive belt to a recording medium, wherein said belt part is openable upward away from said body part about a shaft mounted on a rear portion of said body part, and said belt part can only be opened after said image transfer part has been opened.

* * * * *